US009068137B2

(12) United States Patent
Kupfer et al.

(10) Patent No.: US 9,068,137 B2
(45) **Date of Patent: *Jun. 30, 2015**

(54) WATER-MIXED METAL WORKING FLUIDS CONTAINING ETHER PYRROLIDONE CARBOXYLIC ACIDS

(75) Inventors: Rainer Kupfer, Hattersheim (DE); Carsten Cohrs, Frankfurt (DE); Alexander Roesch, Oppenheim (DE)

(73) Assignee: Clariant Finance (BVI) Limited, Tortola (VG)

( * ) Notice: Subject to any disclaimer, the term of this patent is extended or adjusted under 35 U.S.C. 154(b) by 653 days.

This patent is subject to a terminal disclaimer.

(21) Appl. No.: 13/376,418

(22) PCT Filed: May 19, 2010

(86) PCT No.: PCT/EP2010/003061

§ 371 (c)(1),
(2), (4) Date: Dec. 6, 2011

(87) PCT Pub. No.: WO2010/149250

PCT Pub. Date: Dec. 29, 2010

(65) Prior Publication Data

US 2012/0088706 A1 Apr. 12, 2012

(30) Foreign Application Priority Data

Jun. 25, 2009 (DE) ..... 10 2009 030 409

(51) Int. Cl.

| | |
|---|---|
| ***C10M 133/44*** | (2006.01) |
| ***C07D 207/00*** | (2006.01) |
| ***C07D 295/00*** | (2006.01) |
| ***C10M 173/00*** | (2006.01) |
| ***C23F 11/10*** | (2006.01) |
| ***C23F 11/14*** | (2006.01) |

(52) U.S. Cl.

CPC ..... *C10M 173/00* (2013.01); *C10M 2201/087* (2013.01); *C10M 2203/10* (2013.01); *C10M 2203/1006* (2013.01); *C10M 2215/042* (2013.01); *C10M 2215/223* (2013.01); *C10N 2230/12* (2013.01); *C10N 2230/18* (2013.01); *C10N 2230/24* (2013.01); *C10N 2240/40* (2013.01); *C10N 2250/021* (2013.01); *C10N 2270/02* (2013.01); *C23F 11/10* (2013.01); *C23F 11/143* (2013.01); *C23F 11/149* (2013.01)

(58) Field of Classification Search

CPC .. C07D 207/00; C07D 207/26; C07D 207/28; C10M 133/44; C10M 2215/223

USPC ..... 508/297; 548/519, 531

See application file for complete search history.

(56) References Cited

U.S. PATENT DOCUMENTS

| | | | |
|---|---|---|---|
| 2,908,711 | A | 10/1959 | Halter et al. |
| 3,035,907 | A | 5/1962 | Halter et al. |
| 3,218,264 | A | 11/1965 | Katz |

(Continued)

FOREIGN PATENT DOCUMENTS

| | | |
|---|---|---|
| DE | 102007015757 | 10/2008 |
| EP | 0512501 | 11/1992 |

(Continued)

OTHER PUBLICATIONS

Translation of International Preliminary Examination Report for PCT/EP2010/003063, dated Jan. 19, 2012.

(Continued)

*Primary Examiner* — Vishal Vasisth
(74) *Attorney, Agent, or Firm* — Tod A. Waldrop

(57) ABSTRACT

The invention relates to compositions containing a basic oil or base oil, 10 to 50 percent by weight of ether pyrrolidone carboxylic acids of formula (1) or the salts thereof of formula (1), (1)

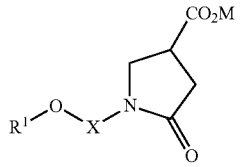

wherein $R^1$ represents $C_8$-$C_{30}$-alkyl, $C_8$-$C_{30}$-alkenyl, $C_6$-$C_{30}$-alyl, $C_7$-$C_{30}$-alkylaryl, M represents hydrogen, alkali metal, alkaline earth metal, or ammonium, X represents $C_2$-$C_6$-alkylene, or a poly(oxyalkylene) group of formula (2), (2)

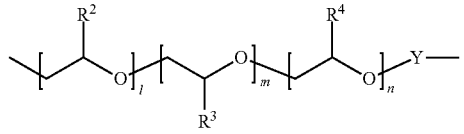

wherein l is a number ranging from 1 to 50, m, n are numbers ranging from 0 to 50 independently of l and independently of one another, $R^2$, $R^3$, and $R^4$ independently represent hydrogen, $CH_3$, or $CH_2CH_3$, Y represents $C_2$-$C_6$-alkylene, said compositions further containing a specific amount of a pH regulator/neutralizer such that a 5 percent by weight emulsion of the composition in deionized water has a pH ranging from 7 to 11.

12 Claims, No Drawings

(56) References Cited

U.S. PATENT DOCUMENTS

| | | | | |
|---|---|---|---|---|
| 3,224,968 | A | 12/1965 | Hinkamp | |
| 3,224,975 | A | 12/1965 | Hinkamp | |
| 3,728,277 | A | 4/1973 | Foley et al. | |
| 4,070,370 | A * | 1/1978 | Elliott et al. | 548/519 |
| 4,235,811 | A | 11/1980 | Schulze et al. | |
| 4,298,708 | A | 11/1981 | Schulze et al. | |
| 4,304,690 | A | 12/1981 | Schulze et al. | |
| 4,332,720 | A | 6/1982 | Schulze et al. | |
| 4,397,750 | A | 8/1983 | Chibnik | |
| 4,983,384 | A | 1/1991 | O'Lenick, Jr. | |
| 5,759,963 | A | 6/1998 | Hille et al. | |
| 6,548,456 | B1 * | 4/2003 | Mulder et al. | 508/268 |
| 6,822,039 | B1 | 11/2004 | Montfreux-Gaillard et al. | |
| 2003/0194388 | A1 | 10/2003 | Dahlmann et al. | |
| 2012/0088698 | A1 | 4/2012 | Kayser et al. | |
| 2012/0088705 | A1 | 4/2012 | Kupfer et al. | |

FOREIGN PATENT DOCUMENTS

| | | |
|---|---|---|
| EP | 1354905 | 10/2003 |
| GB | 1323061 | 7/1973 |
| WO | WO00/31154 | 6/2000 |
| WO | WO00/53701 | 9/2000 |
| WO | WO2005/111115 | 11/2005 |
| WO | WO2008/119502 | 10/2008 |

OTHER PUBLICATIONS

International Search Report for PCT/EP2010/003063, dated Sep. 17, 2010.
Translation of International Preliminary Examination Report for PCT/EP2010/003062, dated Feb. 9, 2012.
International Search Report for PCT/EP2010/003062, dated Sep. 17, 2010.
Translation of International Preliminary Examination Report for PCT/EP2010/003061, dated Jan. 26, 2012.
International Search Report for PCT/EP2010/003061, dated Sep. 17, 2010.
Composition and Properties of Oil Well Drilling Fluids, 5th edition, H.C.H. Darley and George R. Gray, Gulf Publishing Company, p. 166, 1988.
G.L. Hollis, Surfactants Europa, third edition, Royal Society of Chemistry, chapter 4, 139-317, 1995.
J. P. Byers, Metalworking fluids, Taylor and Francis, Boca Rotan, 2006, p. 132 ff.
J. P. Byers, Metalworking Fluids, Taylor and Francis, 2006, p. 128ff.
M.J. Schick, Nonionic Surfactants, Marcel Dekker, Inc., New York, 1967.
P.A. Boyd et al., "New base oil used in low toxicity oil muds" Journal of Petroleum Technology, 1985, 137-142.
Petroleum Engineer International, Sep. 1987, 32-40.
Shinoda et al., Encyclopedia of Emulsion Technology, 1983, vol. 1, pp. 337-367.
T. Mang, W. Dressel, Lubricants and Lubrications, Wiley, Weinheim, 2001, p. 378.
Theo Mang, et al., Lubricants & Lubrications, WileyVCH, Weinheim, 2001, Chapter 14.
Composition and Properties of Oil Well Drilling Fluids, 4th edition, H.C.H. Darley and George R. Gray, Gulf Publishing Company, Chapter 11, 1980.
Walker, et al., World Oil, Nov. 1983, pp. 93-100.
English abstract for DE102007015757, Oct. 2, 2008.
English abstract for W02008119502, Oct. 9, 2008.

* cited by examiner

WATER-MIXED METAL WORKING FLUIDS CONTAINING ETHER PYRROLIDONE CARBOXYLIC ACIDS

This application is a 371 of PCT/EP2010/003061, filed May 19, 2010.

The present invention relates to water-mixed metalworking fluids and concentrates for preparing water-mixed metalworking fluids which comprise etherpyrrolidonecarboxylic acids or salts thereof which exhibit emulsifying and corrosion-inhibiting activity.

On a worldwide basis, water-mixed metalworking fluids represent the largest volume among the metalworking fluids, and, among these fluids in turn, the greatest fraction is occupied by emulsions. These emulsions are prepared by mixing with water from concentrates with a composition typically as follows:

a) base oil, e.g., mineral oil, synthetic hydrocarbons, alkylated aromatics, fatty acid esters, natural oils, and synthetic polymer esters
b) emulsifiers
c) corrosions inhibitors
d) pH regulators/neutralizing agents, e.g. amines and alkanolamines
e) stabilizers, phase mediators
f) extreme pressure additives (EP)
g) anti-wear additives (AW)
h) defoamers
i) biocides
j) complexing agents to counter metal ions, e.g., water hardness
k) nonferrous-metal inhibitors In quantitative terms, aside from the base oil, the emulsifiers and corrosion inhibitors are predominant in the concentrate. As well as nonionic emulsifiers, ionic emulsifiers in particular are employed, some of which also have a corrosion-inhibiting effect. Here one of the key requirements imposed on the emulsifiers, as well as stabilizing the emulsion, is a rapid, "spontaneous" formation of emulsion, manifested in a rapid spreading of the concentrate on introduction into the water phase ("blooming").

Generally speaking, concentrate and water in this case are mixed in a ratio of 1:5 to 1:100, preferably 1:10 to 1:30.

For economic reasons, and in order to reduce the complexity of the mixture, it is preferred to use additives which have two or more functions, in order to reduce the number of additives or their quantity. The fewer the additives and the better their compatibility with one another, the lesser the need to use stabilizers or phase mediators. Also desirable are additives which obviate or at least reduce the use of additives such as biocides, defoamers and complexing agents to counter water hardness. From an environmental standpoint, additives are nowadays also required that are readily biodegradable.

While nonionic emulsifiers have no corrosion-inhibiting effect, the common textbooks (e.g., Theo Mang, W. Dressel, "Lubricants and Lubrication", Wiley-VCH, Weinheim, 2008; p, 400ff, or J. P, Byers, "Metalworking fluids", Taylor and Francis, Boca Raton, 2006; p, 132 ff.) disclose anionic emulsifiers which have a corrosion-inhibiting effect, examples being fatty acids and naphthenic acids, which at the prevailing pH levels of between 7 and 11 are present in anionic form, petroleum sulfonates, or phosphoric monoesters and diesters. The textbooks also describe, however, how these classes of substance share a more or less severe instability toward hard water. Since metalworking fluids are generally prepared using mains water, and since the number of metal ions increases as a result of evaporation of the make-up water and leaching of the metallic workpieces that are worked, over the period within which the fluids are used, which in some cases is several months, the use of these compounds is restricted, particularly in hard water areas.

EP-A-0 501 368 describes alkenylsuccinic monoamides and monoimides which constitute outstanding corrosion inhibitors and emulsifiers, which generally have a certain degree of hard water stability, and which do not exhibit excessive foaming. The monoamides in particular, however, have a certain instability toward hydrolysis, which curtails the time for which the emulsifiers can be used.

EP-A-1 354 905 and the literature cited therein describe ethercarboxylic acids which can be used as emulsifiers with corrosion-inhibiting activity in metalworking fluids and which have very good hard water stability. In some cases, however, the corrosion-inhibiting activity is weak. These compounds, unfortunately, have a severe foaming propensity, as also indicated by their use in laundry detergents and cleaning products. Moreover, their preparation entails a high level of water consumption and the production of large quantities of sodium chloride, and this is unfortunate from an environmental and economic standpoint.

It was an object of the present invention to find readily available, low-foaming emulsifiers that are stable in hard water and have good corrosion control properties, for use in water-mixed metalworking fluids.

It has now been found that etherpyrrolidonecarboxylic acids, which are available from etheramines and itaconic acid in a condensation reaction, are outstandingly suitable as emulsifiers in water-mixed metalworking fluids, since they have very good hard water stability and are superior to the known ethercarboxylic acids in foaming propensity and corrosion control. A further advantage is that they are highly compatible with the majority of known additional additives such as nonionic emulsifiers, corrosion inhibitors, and EP/AW additives, and are therefore easy to formulate.

The present invention provides compositions comprising a base oil, 10% to 50% by weight of etherpyrrolidonecarboxylic acids of the formula (1) or salts thereof (1)

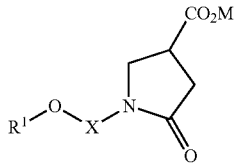

in which $R^1$ is $C_8$-$C_{30}$-alkyl, $C_8$-$C_{30}$-alkenyl, $C_6$-$C_{30}$-aryl, $C_7$-$C_{30}$-alkylaryl M is hydrogen, alkali metal, alkaline earth metal or ammonium X is $C_2$-$C_6$-alkylene, or a poly(oxyalkylene) group of the formula (2)

(2)

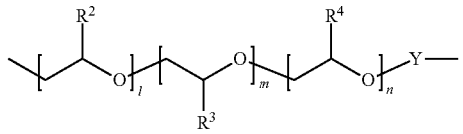

in which l is a number 1 to 50, m, n independently of l and of one another are a number from 0 to 50, $R^2$, $R^3$, $R^4$ independently of one another are hydrogen, $CH_3$ or $CH_2CH_3$ Y is $C_2$-$C_6$-alkylene, and also a pH regulator/neutralizing agent in an amount such that a 5% by weight emulsion of the composition in DI water takes on a pH of between 7 and 11.

The composition of the invention is also referred to herein as concentrate. Similarly, the terms "metalworking product" and "metalworking fluid" are used synonymously.

The invention further provides a hydrous metalworking product comprising the composition of the invention and water in a weight ratio of 1:5 to 1:100. The hydrous metalworking product of the invention is present generally in the form of an emulsion.

The invention further provides for the use of etherpyrrolidonecarboxylic acids of the formula (1) as emulsifier and/or corrosion inhibitor in hydrous metalworking products in concentrations of 0.1-10%.

The composition of the invention preferably comprises the base oil ad 100% by weight.

The substituents M of the formula (1) in the case of the free acid are hydrogen and in the case of salts are alkali metal ions, alkaline earth metal ions or ammonium ions. In the case of the ammonium ions, the compounds in question are preferably compounds originating by protonation from the amines described in the text below as pH regulators/neutralizing agents.

The radical $R^1$ preferably comprises a linear or branched $C_8$-$C_{30}$-alkyl or alkenyl chain, such as n- or isooctyl, n- or isononyl, n- or isodecyl, undecyl, dodecyl, tetradecyl, hexadecyl, octadecyl, eicosyl or longer radicals. It is also possible for $R^1$ to be a $C_6$-$C_{30}$-aryl radical which is mono- or polycyclic and may carry substituents, especially alkyl chains.

In one preferred embodiment of the invention the radical $R^1$—O derives from a synthetic alcohol such as isotridecanol or from a Fischer-Tropsch alcohol, of the kind available commercially under the tradename Lial® or Exxal®.

In a further preferred embodiment the radical $R^1$—O originates from a fatty alcohol or mixtures of fatty alcohols. Suitable fatty alcohols are, for example, capryl alcohol, lauryl alcohol, myristyl alcohol, cocoyl, palmityl, stearyl, oleyl, ricinyl, linoleyl, behenyl alcohol and tallow fatty alcohol. With particular preference the radical $R^1$—O originates from oleylcetyl alcohol.

In a further preferred embodiment the radical $R^1$—O derives from alkylphenol, e.g., butylphenol, tert-butylphenol, octylphenol, nonylphenol, dodecylphenol, tetra-, hexa-, octadecenylphenol, and eicosadecenylphenol, $C_{22}$, $C_{24}$, $C_{28}$ or $C_{30}$ alkylphenol or mixtures thereof.

X and Y are preferably a group of the formula —$(CHR^{16})_k$—, in which $R^{16}$ is H, $CH_3$ or $CH_2CH_3$ and k is a number from 2 to 6. $R^{16}$ is preferably H. k is preferably a number from 2 to 4. More preferably —$(CHR^{16})_k$— stands for groups of the formulae —$CH_2$—$CH_2$—, —$CH_2$—$CH(CH_3)$—, —$(CH_2)_3$— or —$CH_2$—$CH(CH_2CH_3)$—. $R^{16}$ may have the same definition in all units —$(CH_7R^{16})$—, or may have different definitions.

l is preferably a number from 2 to 10.

m is preferably a number from 1 to 10. In a further preferred embodiment m is zero, 1, 2 or 3.

n is preferably a number from 1 to 10. In a further preferred embodiment m is zero 1, 2 or 3 and n is zero.

The preparation of the etherpyrrolidonecarboxylic acids is known from the prior art and takes place as described in examples 1 to 3 by addition reaction of itaconic acid with the corresponding etheramines $R^1$—O—X—$NH_2$, which are available commercially, for example, under the name Jeffamine®, or else are obtainable by amination from the alcohols or alcohol alkoxylates directly, or by addition reaction of acrylonitrile with the alcohols or alcohol ethoxylates, with subsequent hydrogenation.

U.S. Pat. Nos. 4,304,690, 4,298,708 and 4,235,811 describe by way of example the preparation of the etherpyrrolidonecarboxylic acids and their use in laundry detergents and as a catalyst for producing polyurethane foams.

Besides the etherpyrrolidonecarboxylic acids, the compositions of the invention comprise at least one base oil selected from the group of the mineral oils. synthetic hydrocarbons, alkylated aromatics, natural oils, fatty acid esters, synthetic esters or synthetic hydrocarbon polymers and polymer esters.

For the establishment of the desired pH, which is preferably 8-10 and more preferably 8.5 to 9.5, the compositions of the invention and the hydrous metalworking products comprise neutralizing agents.

Suitable neutralizing agents are amines of the formula (3)

$$NR^7R^8R^9 \quad (3)$$

in which $R^7$, $R^8$ and $R^9$ independently of one another are hydrogen or a hydrocarbon radical having 1 to 100 carbon atoms.

In a first preferred embodiment, $R^7$ and/or $R^8$ and/or $R^9$ independently of one another are an aliphatic radical. This radical has preferably 1 to 24, more preferably 2 to 18 and especially 3 to 6 carbon atoms. The aliphatic radical may be linear, branched or cyclic. It may also be saturated or unsaturated. The aliphatic radical is preferably saturated. The aliphatic radical may carry substituents such as, for example, hydroxyl, $C_1$-C5-alkoxy, cyano, nitrile, nitro and/or $C_5$-$C_{20}$-aryl groups such as phenyl radicals, for example. The $C_5$-$C_{20}$-aryl radicals may in turn be substituted optionally by halogen atoms, halogenated alkyl radicals, $C_1$-$C_{20}$-alkyl, $C_2$-$C_{20}$-alkenyl, hydroxyl, $C_1$-$C_5$-alkoxy such as for example methoxy, amide, cyano, nitrile, and/or nitro groups. In one particularly preferred embodiment $R^7$ and/or $R^8$ and/or $R^9$ independently of one another are hydrogen, a $C_1$-$C_6$-alkyl, $C_2$-$C_6$-alkenyl or $C_3$-$C_6$-cycloalkyl radical and especially an alkyl radical having 1, 2 or 3 carbon atoms. These radicals may carry up to three substituents. Particularly preferred aliphatic radicals $R^1$ and/or $R^2$ are hydrogen, methyl, ethyl, hydroxyethyl, n-propyl, isopropyl, hydroxypropyl, n-butyl, isobutyl and tert-butyl, hydroxybutyl, n-hexyl, cyclohexyl, n-octyl, n-decyl, n-dodecyl, tridecyl, isotridecyl, tetradecyl, hexadecyl, octadecyl and methylphenyl.

In another preferred embodiment $R^7$ and $R^8$, together with the nitrogen atom to which they are attached, form a ring. This ring has preferably 4 or more such as, for example, 4, 5, 6 or more ring members. Preferred further ring members in this case are carbon, nitrogen, oxygen and sulfur atoms. The rings may in turn carry substituents such as alkyl radicals, for example. Examples of suitable ring structures are morpholinyl, pyrrolidinyl, piperidinyl, imidazolyl and azepanyl radicals.

In another preferred embodiment $R^7$, $R^8$ and/or $R^9$ independently of one another are an optionally substituted $C_6$-$C_{12}$-aryl group or an optionally substituted heteroaromatic group having 5 to 12 ring members.

In a further preferred embodiment $R^7$, $R^8$ and/or $R^9$ independently of one another are an alkyl radical which is interrupted by heteroatoms. Particularly preferred heteroatoms are oxygen and nitrogen.

Accordingly, $R^7$, $R^8$ and/or $R^9$ independently of one another are preferably radicals of the formula (4)

$$—(R^{10}—O)_a—R^{11} \quad (4)$$

in which $R^{10}$ is an alkylene group having 2 to 6 carbon atoms and preferably having 2 to 4 carbon atoms such as, for example, ethylene, propylene, butylene or mixtures thereof, $R^{11}$ is hydrogen, a hydrocarbon radical having 1 to 24 carbon atoms or a group of the formula $—R^{10}—NR^{12}R^{13}$, a is a number between 2 and 50, preferably between 3 and 25 and in particular between 4 and 10, and $R^{12}$, $R^{13}$ independently of one another are hydrogen, an aliphatic radical having 1 to 24 carbon atoms and preferably 2 to 18 carbon atoms, an aryl group or heteroaryl group having 5 to 12 ring members, a poly(oxyalkylene) group having 1 to 50 poly(oxyalkylene) units the polyoxyalkylene units deriving, from alkylene oxide units having 2 to 6 carbon atoms, or $R^{12}$ and $R^{13}$ together with the nitrogen atom to which they are attached, for a ring having 4, 5, 6 or more ring members.

With further preference $R^7$, $R^8$ and/or $R^9$ independently of one another are radicals of the formula (5)

$$—[R^{14}—N(R^{15})]_b—(R^{15}) \quad (5)$$

in which $R^{14}$ is an alkylene group having 2 to 6 carbon atoms and preferably having 2 to 4 carbon atoms such as, for example, ethylene, propylene or mixtures thereof, each $R^{15}$ independently of any other is hydrogen, an alkyl or hydro alkyl radical having up to 24 carbon atoms such as, for example, 2 to 20 carbon atoms, a polyoxyalkylene radical $—(R^{10}—O)_p—R^{11}$, or a polyiminoalkylene radical $—[R^{14}—N(R^{15})]_q—(R^{15})$, where $R^{10}$, $R^{11}$, $R^{14}$ and $R^{15}$ have the definitions given above, and q and p independently of one another are 1 to 50, and b is a number from 1 to 20 and preferably 2 to 10 such as, for example, three, four, five or six. The radicals of the formula (5) contain preferably 1 to 50, especially 2 to 20, nitrogen atoms.

Particularly preferred are water-soluble alkylamines such as methylamine, dimethylamine, trimethylamine, ethylamine, diethylamine, triethylamine, propylamine, and longer-chain mono-, di- and trialkylamines, provided they are water-soluble. The alkyl chains in these cases may be branched. Also suitable are oligoamines such as ethylenediamine, diethylenetriamine, triethylenetetramine, tetraethylenepentamine, the higher homologs thereof, and also mixtures of these. Other suitable amines in this series are the alkylated, particularly methylated, representatives of these oligoamines, such as N,N-dimethyldiethyleneamine, N,N-dimethylpropylamine, and longer-chain and/or more highly alkylated amines of the same structural principle. Particularly suitable in accordance with the invention are alkanolamines such as monoethanolamine, diethanolamine, triethanolamine, diglycolamine, triglycolamine, and higher homologs, methyldiethanolamine, ethyldiethanolamine, propyldiethanolamine, butyldiethanolamine and longer-chain alkyldiethanolamines, it being possible for the alkyl radical to be cyclic and/or branched. Further suitable alkanolamines are dialkylethanolamines such as dimethylethanolamine, diethylethanolamine, dipropylethanolamine, dibutylethanolamine and longer-chain dialkylethanolamines, it also being possible for the alkyl radical to be branched or cyclic. In the sense of the invention it is also possible, furthermore, to use aminopropanol, aminobutanol, aminopentanol and higher homologs, and also the corresponding mono- and dimethylpropanolamines and longer-chain mono- and dialkylamino alcohols. Suitable not least are specific amines such as 2-amino-2-methylpropanol (AMP), 2-aminopropanediol, 2-amino-2-ethylpropanediol, 2-aminobutanediol and other 2-aminoalkanols, aminoalkylamine alcohols, tris(hydroxylmethyl)aminomethane, and also end capped representatives such as methylglycolamine, methyldiglycolamine and higher homologs, di(methylglycol)amine, di(methyldiglycol)amine and their higher homologs, and also the corresponding triamines and polyalkylene glycol amines (e.g., Jeffamine®). Typically, and in the sense of the invention, mixtures of the aforementioned amines are used in order to set desired pH levels.

Further suitable neutralizing agents are the oxides and hydroxides of the alkali metals and/or alkaline earth metals, such as lithium hydroxide, sodium hydroxide, potassium hydroxide, calcium hydroxide and calcium oxide, for example.

The neutralizing agents are used in amounts needed to establish a pH of between 7 and 11. Depending on neutralizing agent, the amounts needed to achieve this are situated preferably, in the composition of the invention, between 1%-30%, preferably 5%-15%, and, in the hydrous metalworking fluid, 0.01% -6%, preferably 0.1%-1.5% (percentages by weight).

Besides base oil, etherpyrrolidonecarboxylic acid or salt thereof and pH regulator/neutralizing agent, the compositions of the invention may also comprise further emulsifiers, preferably non-ionic emulsifiers. Suitable emulsifiers are, for example, fatty alcohol ethoxylates, fatty acid ethoxylates, fatty acid amide ethoxylates. Fatty acids suitable for the purpose are capryl, lauryl, myristyl, cocoyl, palmityl, steely, oleyl, ricinyl, linoleyl, behenyl and ricinaleic acid and also mixtures thereof, from which the suitable fatty alcohols and fatty amides as well can be prepared. The degree of ethoxylation is generally 1-10, preferably 2-6 mol of ethylene oxide per functional group (OH, COOH, NH). Also suitable in the same way are ethoxylates of castor oil, and the esters thereof.

Present typically in the compositions of the invention are 1%-50%, preferably 5%-25%, more preferably 10%-20%, and, in the hydrous metalworking product, 0.01%-10%, preferably 0.05-2.5%, more preferably 0.1%-2%, of non-ionic emulsifiers (weight percentages based on total weight).

In accordance with the invention it is also possible for the anionic emulsifiers mentioned in the introduction to be present, such as petroleum sulfonates, fatty acids, alkenylsuccinic monoamides and monoimides, and also ethercarboxylic acids, in the composition of the invention or in the hydrous metalworking product, but generally only in amounts in which the adverse properties do not have any substantial consequence. As a result, these additives may also make a synergistic contribution to corrosion control. The anionic emulsifiers can be added as salts or in their free acid form, and are converted to their anionic form by the neutralizing agents present.

In a further embodiment of the invention, the composition of the invention or the hydrous metalworking product may comprise further corrosion inhibitors, especially water-soluble corrosion inhibitors. Examples of suitable corrosion inhibitors are benzenesulfonamidocaproic acid, toluenesulfonamidocaproic acid, N-methylbenzenesulfonamidocaproic acid, N-methyltoluenesulfonamidocaproic acid all formula (6)), alkanoylamidocarboxylic acids, especially isononanoylamidocaproic acid (formula (7)), and triazine-2,4,6-tris(aminohexanoic acid) (formula (8)), and the alkali metal, alkaline earth metal and amine salts of the compounds of the formula (6)-(8).

a) Toluene- or benzenesulfonamidocaproic acids (formula (6))

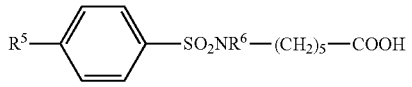

(6)

with $R^5$, $R^6$=H or $CH_3$ b) Isononanoylamidocaproic acid (formula (7))

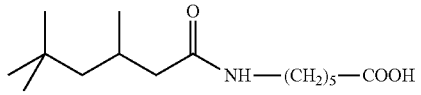

(7)

c) Triazinetrisaminohexanoic acid (formula (8))

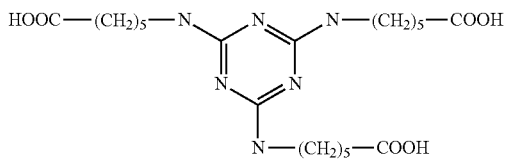

(8)

Other known and suitable corrosion inhibitors are linear branched carboxylic acids such as, for example, octanoic acid, 2-ethylhexanoic acid, n-nonanoic acid, n-decanoic acid, n-isodecanoic acid and further carboxylic acids, dicarboxylic acids such as succinic acid, adipic acid, maleic acid, citric acid, and also longer-chain dicarboxylic acids such as decanedioic acid, undecanedioic acid or dodecanedioic acid, where the chains may be branched or else cyclic, and polycarboxylic acids. Corrosion inhibitors that are also suitable are alkanesulfonamides, alkanesulfonamidocarboxylic acids and phthalic monoamides. Furthermore, it is also possible to use the salts of the compounds listed above, One widespread corrosion inhibitor which may likewise be used in accordance with the invention is boric acid and its salts.

Further suitable corrosion inhibitors are carboxamides, especially carboxylic alkanolamides. These compounds are, especially, the alkanolamides of the fatty acids, e.g. tall oil fatty acid monoethanolamide, tall oil fatty acid diethanolamide, coconut fatty acid monoethanolamide, coconut fatty acid diethanolamide, and also the mono- and diethananolamides of oleic acid, linolenic acid, stearic acid, and the other known fatty acids. These alkanolamides may also be prepared directly from the fats and oils, as for example from tallow oil, rapeseed oil, fish oil, olive oil, vegetable oil in general, sunflower oil or castor oil.

These corrosion inhibitors may be part of the composition of the invention, but may also be added to the water phase during the preparation of the hydrous metalworking product. Their concentration in the composition of the invention may be preferably 1%-20%, more particularly 1%-10%, more preferably 2%-5%. In the water phase, 0.1%-10%, preferably 0.1%-5%, more preferably 0.5%-2% is added. In the hydrous metalworking product, there is typically 0.01%-4%, preferably 0.01%-1%, more preferably 0.01%-0.5% (weight percentages based on the total weight).

Furthermore, the composition of the invention and the hydrous metalworking product may comprise solubilizers, EP/AW additives such as, for example, chlorinated paraffins, phosphoric mono-, di- and triesters, fatty acid esters, polymeric esters, and also sulfurized oils, fats and olefins, biocides, defoamers, nonferrous-metal inhibitors and complexing agents. In a preferred embodiment, no defamer or complexing agent is necessary, owing to the low foaming propensity and good hard water stability of the additives. The concentration of these additives in the composition of the invention is generally less than 5%, preferably 0.1%-2.5%, more particularly 0.1%-1%. In the hydrous metalworking product, the concentration at which they are used, correspondingly, is 1%-20% of the amounts specified for the concentrate (weight percentages based on the total weight).

The preparation of the hydrous metalworking, products from the compositions of the invention is accomplished by means of suitable stirrers or mixers at temperatures of 20-60°C., preferably without heating. The ratio of concentrate to water phase in this case is 1:20 to 1:100, preferably 1:10 to 1:30.

The preparation of concentrates by mixing of the additives may take place in any desired sequence, but preferably the base oil, selected from the group of the mineral oils, synthetic hydrocarbons, natural oils, fatty acid esters, synthetic esters or synthetic hydrocarbon polymers and polymer esters, is introduced, then the neutralizing agents are added, and then the additives are metered in, in a suitable sequence, so that no gel phases or high viscosities occur. Where the neutralizing agents are wholly or partly hydroxides or oxides, they are generally not added until the end. The etherpyrrolidonecarboxylic acids of the invention can be added at any point in the mixing operation, but preferably after the base oil and amine-based neutralizing agents. At the end of mixing it may be necessary to add suitable solubilizers in order to eliminate turbidity.

EXAMPLES

Example 1-3

General Protocol for Preparing N-substituted 5-oxopyrrolidine-3-carboxylic acids A standard stirring apparatus is charged with 1 equivalent of amine, and this initial charge is heated to 50° C. with stirring. Then, in portions, 1 equivalent of itaconic acid is added and the reaction mixture is heated slowly to 180° C. During the progress of the reaction, 1 equivalent of water of reaction is removed by distillation. The product obtained is characterized by means of acid number (AcN) and amide nitrogen (AN).

Example 1

1-[2-(2-Dodecyloxy-1-methylethoxy)-1-methylethyl]-5-oxopyrrolidine-3-carboxylic acid From 302 g of 2-(2-dodecyloxy-1-methylethoxy)-1-methylethylamine and 130 g of itaconic acid, 410 g of 1-[2-(2-dodecyloxy-1-methylethoxy)-1-methylethyl]-5-oxopyrrolidine-3-carboxylic acid were obtained, with AcN=136 mg KOH/g and AN=3.1%, formula (9)

(9)

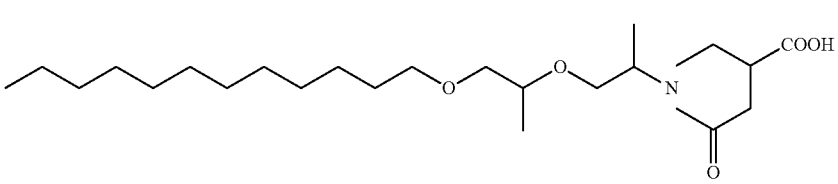

Example 2

5-Oxo-1-[3-(2,5,8-trimethyldecyloxy)propyl]pyrrolidine-3-carboxylic acid. From 257 g of 3-(2,5,8-trimethyldecyloxy)propylamine and 130 g of itaconic acid, 365 g of 5-oxo-1-[3-(2,5,8-trimethyldecyloxy)propyl]pyrrolidine-3-carboxylic acid were obtained, with AcN=151 mg KOH/g, AN=3.8%, formula (10)

(10)

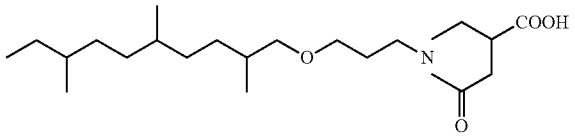

Example 3

5-Oxo-[2-(paranonylphenoxy(tridecyloxypropyl))-1-methylethyl]pyrrolidine-3-carboxylic acid From 255 g of para-nonylphenoxy(tridecyloxypropyl) amine and 32.5 g of itaconic acid, 275 g of 5-oxo[para-nonylphenoxy(tridecyloxypropyl)]pyrrolidine-3-carboxylic acid was obtained, with AcN of 47.1 mg KOH/g and AN of 1.2%, formula (11)

(11)

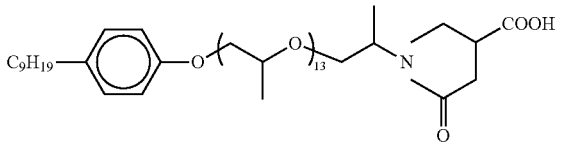

Example 4-10

Composition of Water-Mixable Concentrates and Performance Data on Water-Mixed Metalworking Products (Emulsions)

Inventive composition of the hydrous metalworking product for examples 4-10:

| | |
|---|---|
| Mineral oil (Shell Gravex 915) | 35% |
| Anionic emulsifier (subject matter of invention) | 15% |
| Nonionic emulsifier (Emulsogen M) | 15% |

-continued

| | |
|---|---|
| Boric acid | 10% |
| Diethanolamine (DEA) | 15% |
| Water | 10% |
| Concentrate | 100% |

To achieve clarification it was necessary to add solubilizer to the concentrates: for 100% of concentrate, 3% of tall oil fatty acid and 3% of oleyl alcohol ethoxylated with 2 mol of EO/OH (Genapol O 020) were added. For greater ease of comparison, the concentrates were not optimized to ideal physical properties.

For results see table 1. Examples 4-7 represent the prior art.

TABLE 1

Composition of the water-mixed metalworking fluids and performance outcomes

| Example | 4 | 5 | 6 | 7 | 8 | 9 | 10 |
|---|---|---|---|---|---|---|---|
| Anionic emulsifier | Petroleum sulfonate MW 460 | Ethercarboxylic acid Oleth-5 as DEA salt | Tall oil fatty acid (TOFA) as DEA salt | Alkenylsuccinic monoamide with monoethanolamine | EPC from example 1 as DEA salt | EPC from example 2 as DEA salt | EPC from example 3 as DEA salt |
| Solubilizers | +3% oleyl alcohol +2 EO +3% tall oil fatty acid | +3% oleyl alcohol +2 EO +3% tall oil fatty acid | +3% oleyl alcohol +2 EO +3% tall oil fatty acid | +3% oleyl alcohol +2 EO +3% tall oil fatty acid | +3% oleyl alcohol +2 EO +3% tall oil fatty acid | oleyl alcohol +2 EO +3% tall oil fatty acid | +3% oleyl alcohol +2 EO +3% tall oil fatty acid |
| 5% Emulsion 20° dH [German hardness] | | | | | | | |
| Appearance, instantaneous | highly opalescent | turbid | highly opalescent | transparent | transparent | transparent | highly opalescent |
| Appearance after 24 h | Lime soap deposition | Cream | Lime soap deposition | transparent | transparent | transparent | highly opalescent |
| Appearance in 40° dH water, instantaneous | highly opalescent | turbid | highly opalescent | transparent | transparent | transparent | milky |
| Appearance in 40° dH water after 24 h | Lime soap deposition | opalescent | Lime soap deposition | highly opalescent | transparent | transparent | milky |
| Foam height, instantaneous (shaking) | 50 | 90 | 60 | 85 | 90 | 90 | 75 |
| pH | 9.9 | 8.9 | 9.0 | 9.0 | 8.9 | 8.9 | 9.2 |
| Corrosion control DIN 51360/2 | | | | | | | |
| 5% | 0 | 0 | 0 | 0 | 0 | 0 | 0 |
| 4% | 0 | 0 | 0 | 0 | 0 | 0 | 0 |
| 3% | 3 | 2 | 0 | 0 | 0 | 0 | 0 |

Examples 4-10 show that the hydrous metalworking products comprising the compositions of the invention are comparable in foaming behavior to the prior art (the low foam height in example 4 is caused by the deposition of lime soaps, which have a defoaming effect). The quality of emulsion (milky<opalescent<transparent) is equal where the same concentration is used (example 10) or is significantly better (examples 8 and 9), and is unaffected in hard water. Even at low application concentrations, the corrosion protection exists and is a sharp improvement on examples 4 and 5.

Accordingly, relative to all of the examples from the prior art, the hydrous metal-working products comprising the compositions of the invention exhibit better emulsion quality, better breadth of application and an extended life.

Oleth-5=polyoxyethylene (5)-oleyl ether

DEA=diethanolamine

The invention claimed is:

1. A composition comprising a base oil, 10% to 50% by weight of at least one etherpyrrolidonecarboxylic acid of the formula 1 or salt thereof (1)

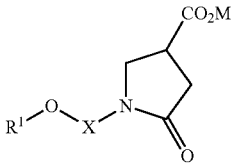

in which $R^1$ is $C_8$—$C_{30}$-alkyl, $C_8$—$C_{30}$-alkenyl, $C_6$—$C_{30}$-aryl, $C_7$—$C_{30}$-alkylaryl M is hydrogen, alkali metal, alkaline earth metal or ammonium X is $C_2$—$C_6$-alkylene, or a poly(oxyalkylene) group of the formula (2)

(2)

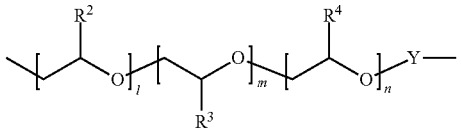

in which

I is a number 1 to 50, m, n independently of I and of one another are a number from 0 to 50, $R^2$, $R^3$, $R^4$ independently of one another are hydrogen, $CH_3$ or $CH_2CH_3$ Y is $C_2$—$C_6$-alkylene, and also a pH regulator/neutralizing agent in an amount such that a 5% by weight emulsion of the composition in deionized water has a pH of between 7 and 11.

2. A composition as claimed in claim 1, in which $R^1$ is a $C_8$—$C_{22}$-alkyl or alkenyl group.

3. A composition as claimed in claim 1, in which X and Y independently of one another are selected from the group consisting of —$(CHR^{16})_k$— with k=2, 3 or 4 and $R^{16}$ =H, $CH_3$ or —$CH_2$—$CH_3$.

4. A composition as claimed in claim 1, in which I is a number from 2 to 10.

5. A composition as claimed in claim 1, in which m and n independently of one another denote a number from 1 to 10.

6. A composition as claimed in claim 1, in which the neutralizing agent is selected from the group consisting of a) amines of the formula (3)

$$NR^7R^8R^9 \quad (3)$$

in which $R^7$, $R^8$ and $R^9$ independently of one another are H or a hydrocarbon radical having 1 to 100 carbon atoms, and b) oxides and hydroxides of alkali metals or alkaline earth metals.

7. A composition as claimed in claim 1, in which 1% to 50% by weight, based on the composition, of non-ionic emulsifiers are present.

8. A composition as claimed in claim 1, in which 1% to 20% by weight, based on the composition, of corrosion inhibitors are present.

9. A composition as claimed in claim 1, in which 0.1% to 5% by weight, based on the composition, of extreme pressure (EP) and/or anti-wear (AW) additives are present.

10. A composition as claimed in claim 1, in which the base oil is present up to 100% by weight.

11. A process for producing a hydrous metalworking fluid comprising the step of mixing a composition as claimed in claim 1 with water in a weight ratio of 1:5 to 1:100.

12. A corrosion inhibitor in hydrous metalworking fluids which comprise a base oil and a neutralizing agent such that the pH of the hydrous metalworking fluids is between 7 and 11 comprising 0.1% to 10% by weight of at least one etherpyrrolidonecarboxylic acid or salt thereof according to formula (1)

(1)

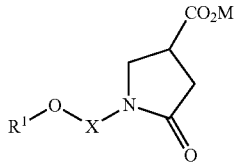

in which $R^1$ is $C_8$—$C_{30}$-alkyl, $C_8$—$C_{30}$-alkenyl, $C_6$—$C_{30}$-aryl, $C_7$-$C_{30}$-alkylaryl M is hydrogen, alkali metal, alkaline earth metal or ammonium X is $C_2$-$C_6$-alkylene, or a poly(oxyalkylene) group of the formula (2)

(2)

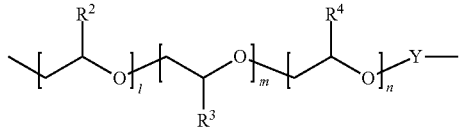

in which

I is a number 1 to 50, m, n independently of I and of one another are a number from 0 to 50, $R^2$, $R^3$, $R^4$ independently of one another are hydrogen, $CH_3$ or $CH_2CH_3$ Y is $C_2$—$C_6$-alkylene.

* * * * *